US007413382B2

(12) United States Patent
Hedstrom et al.

(10) Patent No.: US 7,413,382 B2
(45) Date of Patent: Aug. 19, 2008

(54) COUPLER FOR LEACHING CHAMBER SYSTEMS

(75) Inventors: Kristen K. Hedstrom, Grove City, OH (US); Terrance H. Gray, Bath, ME (US); William V. Shaffer, Powell, OH (US)

(73) Assignee: PSA, Inc., Hilliard, OH (US)

( * ) Notice: Subject to any disclaimer, the term of this patent is extended or adjusted under 35 U.S.C. 154(b) by 0 days.

(21) Appl. No.: 11/620,645

(22) Filed: Jan. 5, 2007

(65) Prior Publication Data

US 2007/0196175 A1 Aug. 23, 2007

Related U.S. Application Data

(63) Continuation of application No. 10/619,060, filed on Jul. 14, 2003, now Pat. No. 7,160,059, which is a continuation of application No. 09/662,473, filed on Sep. 15, 2000, now Pat. No. 6,592,293.

(51) Int. Cl.
*E02B 11/00* (2006.01)
*E02B 13/00* (2006.01)

(52) U.S. Cl. ..... 405/46; 405/44; 405/43; 405/36

(58) Field of Classification Search ..... 405/46, 405/49, 43, 44, 45
See application file for complete search history.

(56) References Cited

U.S. PATENT DOCUMENTS 5,669,733 A * 9/1997 Daly et al. ..... 405/46
6,592,293 B1 * 7/2003 Hedstrom et al. ..... 405/46
7,160,059 B2 * 1/2007 Hedstrom et al. ..... 405/46

* cited by examiner

*Primary Examiner*—Frederick L Lagman
(74) *Attorney, Agent, or Firm*—The Johnson IP Law Firm; Rodney D. Johnson

(57) ABSTRACT

An adjustable coupler is disclosed for interconnecting leaching chambers to create a serpentine pathway for a leaching field. A coupler can connect a first leaching chamber and a second leaching chamber. The coupler can comprise a mating feature and an adjustment feature.

The mating feature can be used to mate the coupler between the first leaching chamber and the second leaching chamber. The mating feature can include a swivel connector matable to an end of one of the chambers.

The adjustment feature can adjust the angle between the first chamber and the second chamber between a range of angles. The adjustment feature can include a swivel connector. The range of angles can be particularly chosen to be about 45°. More particularly, the range of angles can be about 22.5° in either the clockwise or counter-clockwise direction.

58 Claims, 9 Drawing Sheets

COUPLER FOR LEACHING CHAMBER SYSTEMS

RELATED APPLICATION(S)

This application is a continuation of U.S. application Ser. No. 10/619,060 entitled "Adjustable Angle Coupler for Leaching Chamber Systems" and filed by Hedstrom et al. on Jul. 14, 2003 (now U.S. Pat. No. 7,160,059), which is a continuation of U.S. application Ser. No. 09/661,473 entitled "Adjustable Angle Coupler for Leaching Chamber Systems" and filed by Hedstrom et al. on Sep. 15, 2000 (now U.S. Pat. No. 6,592,293), which are related to U.S. application Ser. No. 09/595,674 entitled "Leaching Chamber" and filed by Gray on Jun. 19, 2000 (now U.S. Pat. No. 6,270,287), the entire teachings of which are incorporated herein by reference.

BACKGROUND

Hollow plastic leaching chambers are commonly buried in the ground to form leaching fields for receiving and dispersing liquids such as sewage system effluent or storm water into the surrounding earth. Such leaching chambers have a central cavity for receiving liquids. An opening on the bottom and slots on the sides provide the means through which liquids are allowed to exit the central cavity and disperse into the surrounding earth. Typically, multiple leaching chambers are connected to each other in series to achieve a desired subterranean volume and dispersion area. Leaching chambers are usually arch-shaped and corrugated with symmetrical corrugations for strength. Additionally, leaching chambers usually come in standard sizes. The most common size for most leaching chambers is roughly six feet long, three feet wide and slightly over one foot high.

The amount of liquid that a given leaching chamber is capable of receiving and dispersing is dependent upon the internal volume of the leaching chamber and the dispersion area over which the leaching chamber can disperse the liquids. Because most plastic leaching chambers are arch-shaped for strength, the volume and dispersion area for any given leaching chamber having the same dimensions is roughly the same. Therefore, most present leaching chambers of the same size have roughly the same capacity.

The capacity of a leaching field depends upon the size and the number of leaching chambers employed. If the size or the number of the leaching chambers employed in a leaching field is increased, the volume and dispersion area is increased, thereby increasing capacity of the leaching field. However, increasing the size or the number of leaching chambers also increases the cost as well as the area of land required for burying the leaching chambers.

Efficient use of the land can be increased by having the chambers follow the natural contours of the land. When a leaching field is created from the chambers, they are typically installed with a slight downward slope away from the sewer inlet as mandated by local requirements. The elevation of the land, however, may change over the area of the leaching field. Arching and serpentine pathways can be created to generally follow the contours of the land and to avoid obstacles in the ground. For example, by deviating the pathway from a straight line, the chambers can be better installed at the proper grade while reducing the necessity to dig trenches deeper than necessary. Typical systems permit the pathway to turn, from one chamber to the next, by using a substantially fixed angle adapter between successive chambers.

SUMMARY

While coarse corrections to the path of the chambers make more efficient use of the land, the amount of flexibility during installation is limited. One way to increase flexibility is by employing an adjustable coupler between leaching chambers. This allows more variations in connecting the components to yield a desired serpentine pathway for a leaching field.

In a particular embodiment, a coupler can connect a first leaching chamber and a second leaching chamber. The coupler can comprise a mating feature and an adjustment feature. The coupler can also directly connect to other couplers. Furthermore, the coupler can be a third leaching chamber, which can be a like chamber to the first and second chambers.

The mating feature can be used to mate the coupler between the first leaching chamber and the second leaching chamber. The mating feature can include a swivel connector matable to an end of one of the chambers. The mating feature can also include a flange connector matable to an end of the other chamber.

The adjustment feature can adjust the angle between the first chamber and the second chamber between a range of angles. The adjustment feature can include a swivel connector and the swivel connector can include a post member or a dome structure. The adjustment feature can be bidirectional to facilitate an adjustment in either the clockwise or counterclockwise direction—as measured from the longitudinal direction of the connected chambers. The range of angles can be particularly chosen to be about 45°. More particularly, the range of angles can be about 22.5° in either direction.

A more particular coupler can connect a first leaching chamber and a second leaching chamber, each chamber having a post interconnect and a dome interconnect at respective ends. The coupler can include a post member rotatably connectable with the dome interconnect of the first chamber and a connector for connecting to the post interconnect of the second chamber. The connector can be a flange, which can be a segmented flange. In another embodiment, the connector can include a dome member rotatably connectable to the post interconnect of the second chamber. In yet another embodiment, the connector can include a post member rotatably connectable to the post interconnect of the second chamber.

A boss can also be used to define an adjustable range of angles between the first chamber and the second chamber. The boss can interface with the end of the first chamber to limit the adjustable angle the boss can be bidirectional to facilitate an adjustment either the clockwise or counterclockwise direction. In particular, the range of angles can be about 45°. More specifically, the range of angles can be about 22.5° in either direction.

BRIEF DESCRIPTION OF THE DRAWINGS

The foregoing and other objects, features and advantages of the invention, including various novel details of construction and construction of parts, will be apparent from the following more particular drawings and description of particular embodiments of an adjustable angle coupler for leaching chamber systems in which like reference characters refer to the same parts throughout the different views. The drawings are not necessarily to scale, emphasis instead being placed upon illustrating the principles of the invention. It will be understood that the particular couplers embodying the invention are shown by way of illustration only and not as a limitation of the invention. The principles and features of this invention may be employed and varied in numerous embodiments without departing from the scope of the invention.

DETAILED DESCRIPTION

Figure 1:
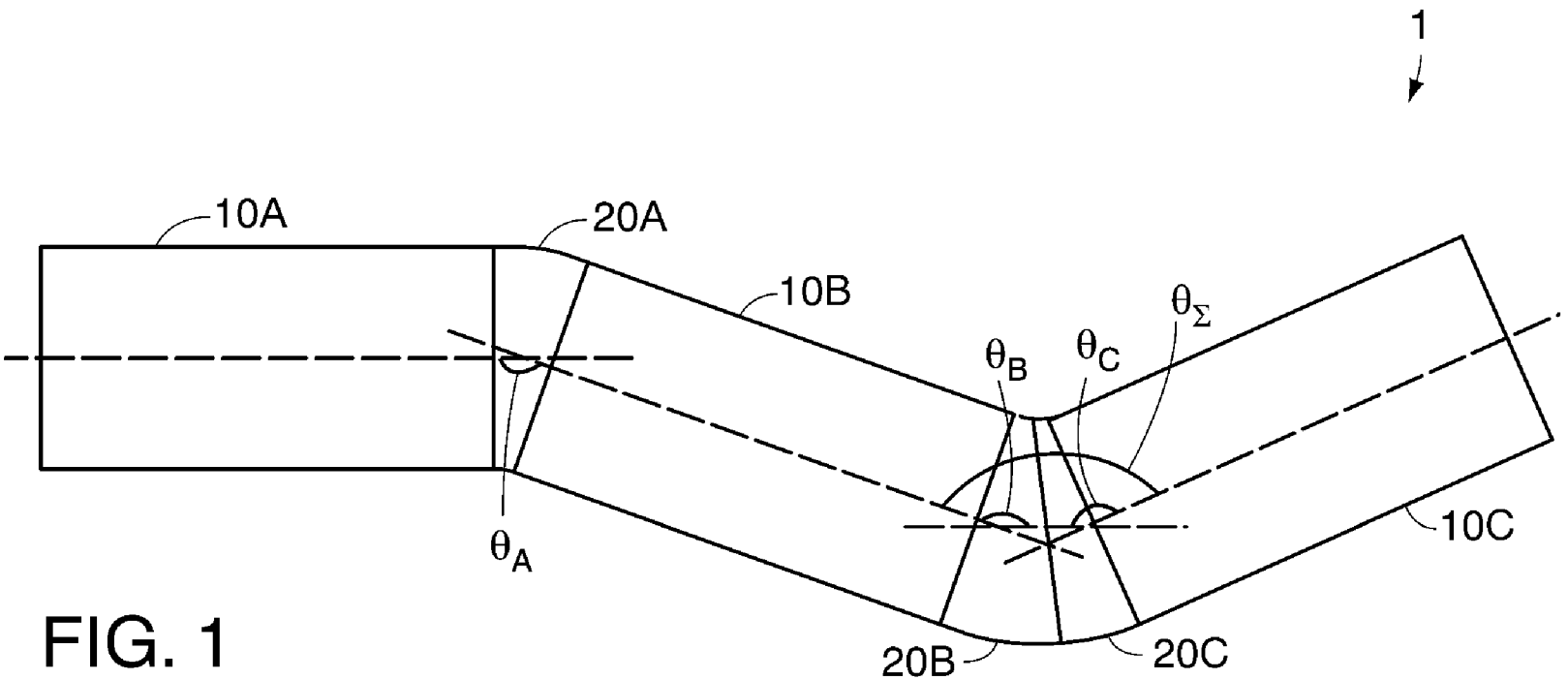
FIG. 1 is a schematic diagram of a leaching chamber system employing adjustable couplers.

FIG. 1 is a schematic diagram of a leaching chamber system employing adjustable couplers. The system 1 includes a plurality of leaching chambers 10A, 10B, 10C interconnected by a plurality of adjustable couplers 20A, 20B, 20C to form a conduit. As shown, each coupler 20A, 30B, 20C can deviate the linear path of the conduit by a respective bias angle $\theta_A$, $\theta_B$, $\theta_C$. The bias angle for each coupler is bidirectionally adjustable within a range of angles in either the clockwise or counter-clockwise direction—as measured from the longitudinal direction of the connected chambers. A particular suitable range of angles is 0-22.5° in either direction—for a 45° range of motion.

Note that the couplers 20 can mate with chambers 10 or other couplers. By interconnecting multiple couplers 20, the range of the turning angle can be multiplied. As shown the resulting angle $\theta_\Sigma$ from the second chamber 10B to the third chamber 10C is the sum of the respective bias angles, $\theta_B+\theta_C$, formed by the second and third couplers 20B, 20C. A particular chamber suitable for embodiments of the invention is described in U.S. Design Pat. No. 403,047 entitled "Post and Dome Interconnect for Leaching Chambers" issued to Gray on Dec. 22, 1998, the teachings of which are incorporated herein by reference in their entirety.

It should also be recognized that the chambers 10 and couplers 20 are both conduits and that the coupler features can be integrally formed with the chambers. In other words, each chamber can have features of the adjustable coupler at one or both ends. In that case, the coupler can be another chamber like the adjacent chambers being interconnected.

Figure 2C:
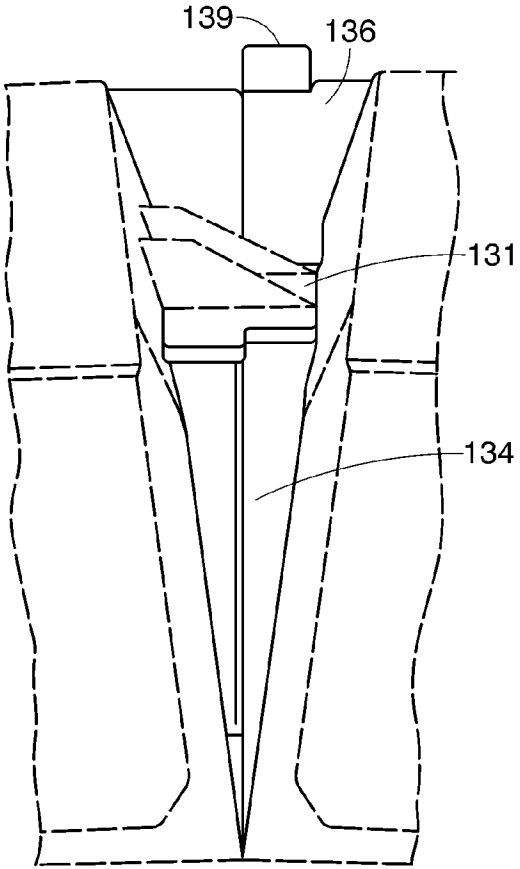
FIGS. 2A-2C are foreshortened side views of chambers having a particular post and dome interconnect.
Figure 2B:
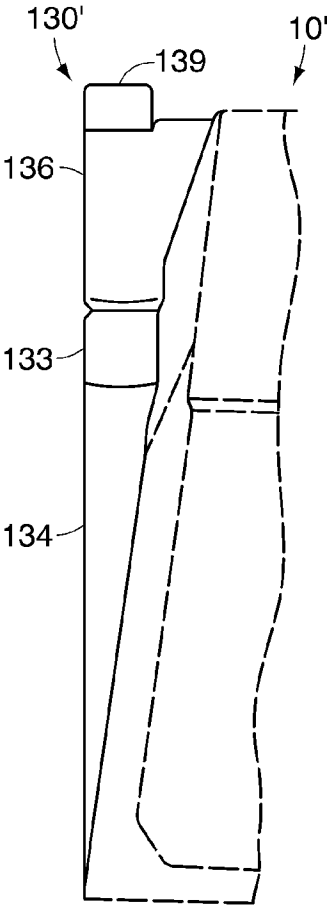
Figure 2A:
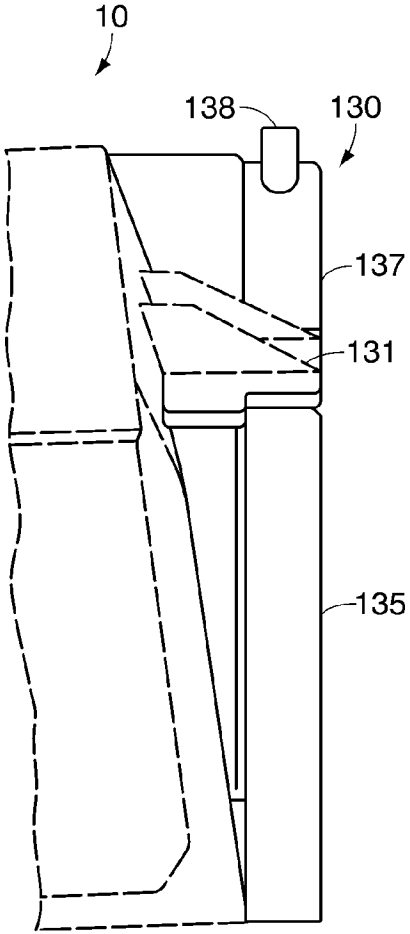

FIGS. 2A-2C are foreshortened side views of chambers having a particular post and dome interconnect. Shown are two identical chambers 10, 10', having complementary end flanges 130, 130'. FIG. 2A shows a post end flange 130, which includes a post interconnect 138 on a lower subarch 137, a lower subarch flange segment 135 and an upper flange segment 131, which can include structural webs (shown in phantom). FIG. 2B shows a dome end flange 130', which includes a dome interconnect 139, an upper subarch flange segment 136, a lower top flange segment 133, and an upper side flange segment 134. FIG. 2C shows the two chambers 10, 10' interconnected by the flanges 130, 130'. In particular, it should be noted that the dome interconnect 139 is manufactured to include a receptacle for receiving the post interconnect 138.

Figure 3:
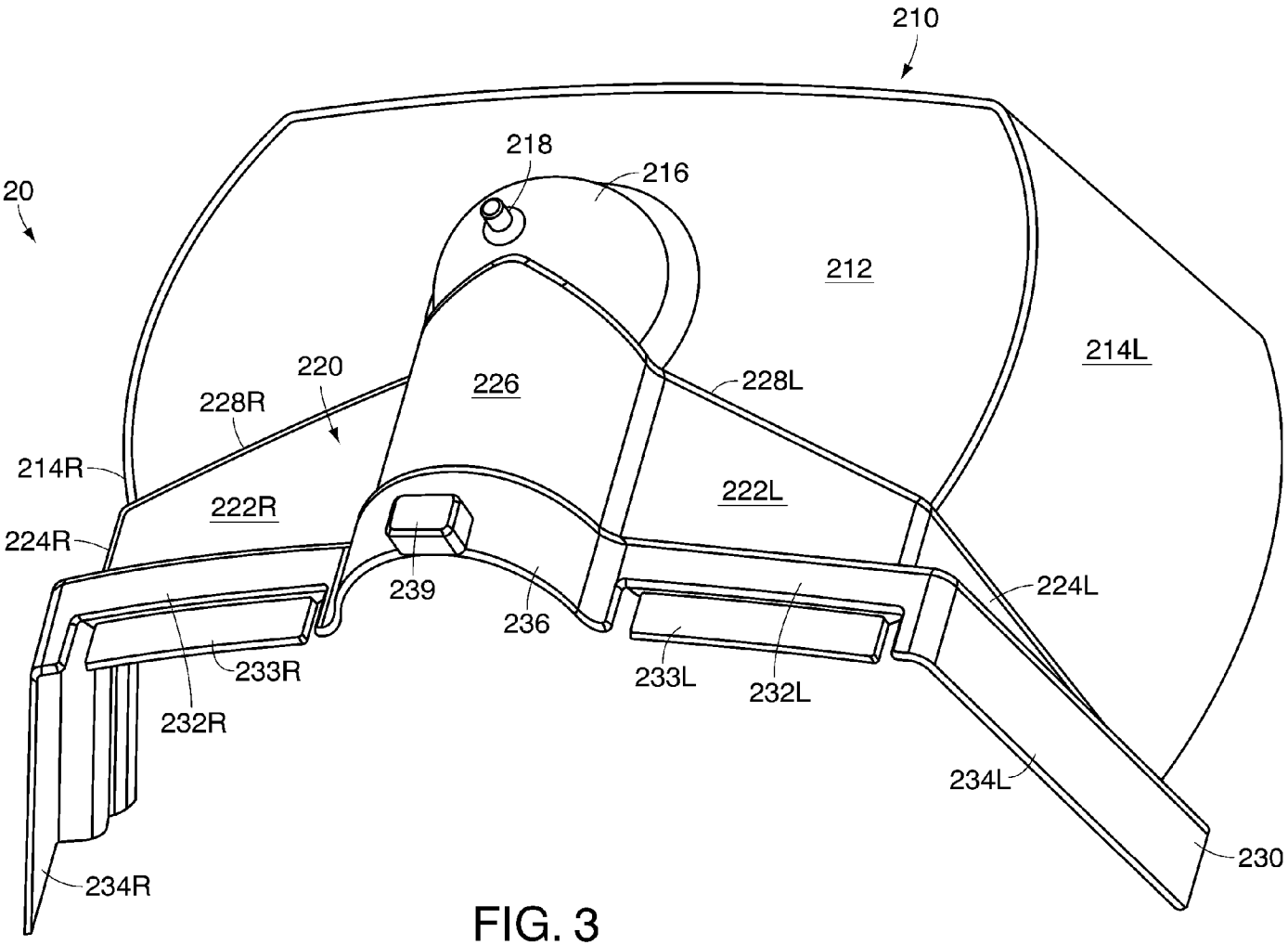
FIG. 3 is a perspective view of a particular coupler of FIG. 1.

FIG. 3 is a perspective view of a particular coupler of FIG. 1. The coupler 20 includes a swivel body 210, an end transition 220 and a matable flange 230. As shown, the coupler 20 is configured to mate with a post and dome interconnect.

As shown, the swivel body 210 includes a top section 212 and left and right side sections 2146L, 214R. The top and side sections are dimensioned to be slidably rotatable within the interior of the mated chamber, as will be described below. A subarch dome section 216 is dimensioned to be slidably rotatable within the interior of the mated chamber subarch, as will also be described below. At the peak of the subarch dome 2176 is a circular post member 218, which can mate with the interconnection dome 139 (FIG. 2B) of a chamber.

The end transition 220 joins the swivel body 210 to the flange 230. It includes left and right top sections 222L, 222R, left and right side sections 224L, 224R, and a subarch section 226. The point of transition from the coupler body 210 is elevated to form a stop or boss on both the left and right sides 228L, 228R. The bosses 228L, 228R define the limits of the turn angle θ in the left and right direction, respectively.

The matable flange 230 is substantially identical to the dome end flange 130' (FIG. 2B) of the chamber mated to by the post member 218. As particularly shown, the flange 230 includes a left and right upper top flange area 232L, 232R, a left and right lower top flange segments 233L, 233R, a left and right lower side flange segment 234L, 234R, and an upper subarch flange segment 236. At the top of the upper subarch flange segment 236 is a dome interconnect 239 that has an empty interior substantially identical to the chamber dome interconnect 139 (FIG. 2B) for meeting with a post of a next chamber.

Figure 4:
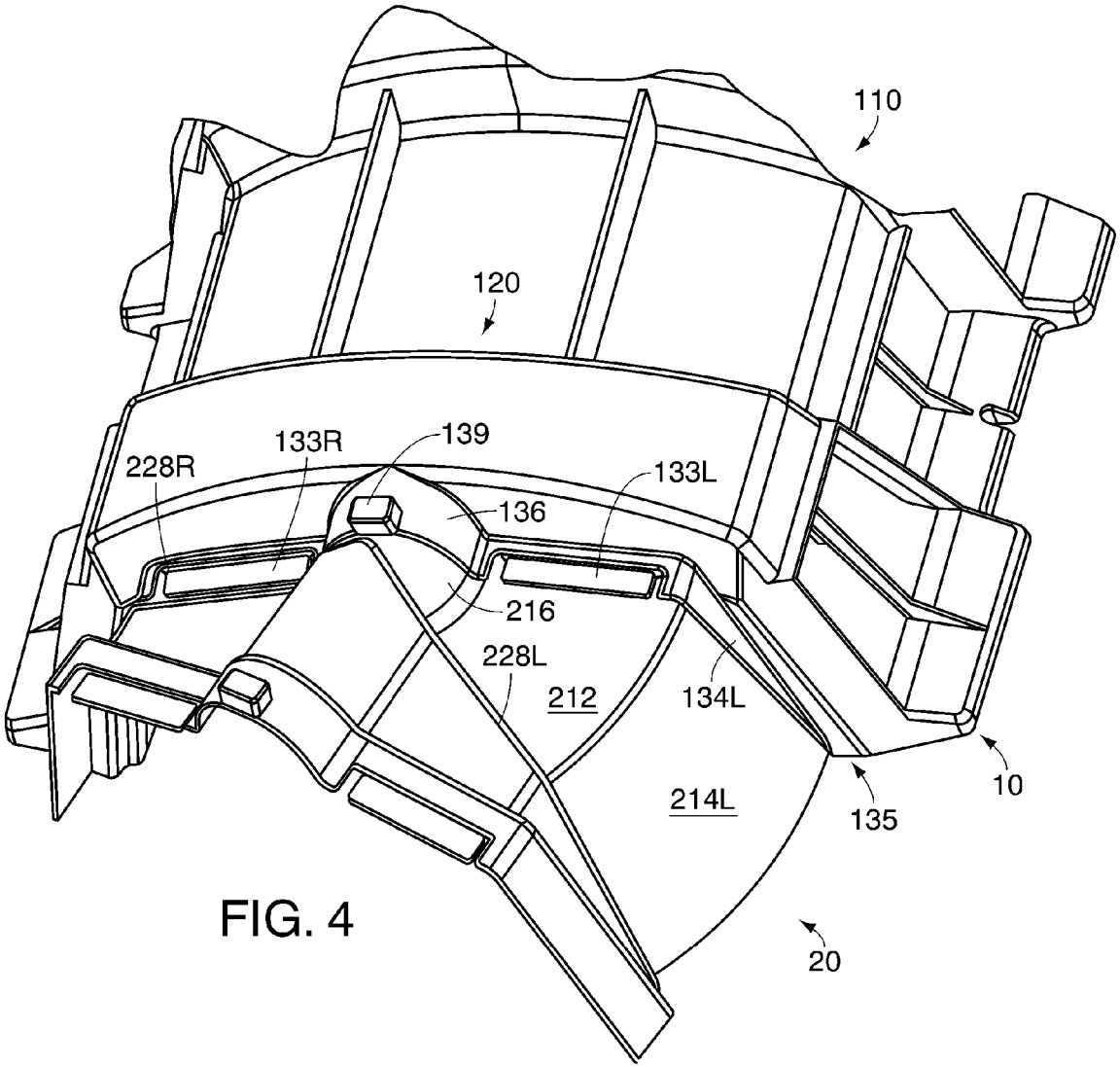
FIG. 4 is a perspective view of the coupler of FIG. 3 mated to a foreshortened leaching chamber.

FIG. 4 is a perspective view of the coupler of FIG. 3 mated to a foreshortened leaching chamber. The leaching chamber 10 is shown having a valley corrugation 110 and a peak corrugation 120. A dome end mating flange 130' is coupled to the coupler 20. As shown, the resulting angle is to the right, limited by the right-side boss 228R stopping the rotation of the chamber flange 130' at its right lower top flange section 133R.

It should be noted that the above embodiment is specific to the domed end of the leaching chamber 10. This arrangement has an advantage because the entire coupler body 210 fits within and under the chamber 10. A similar technique can, however, be applied to the opposite, post end 130 of the chamber 10.

Figure 5:
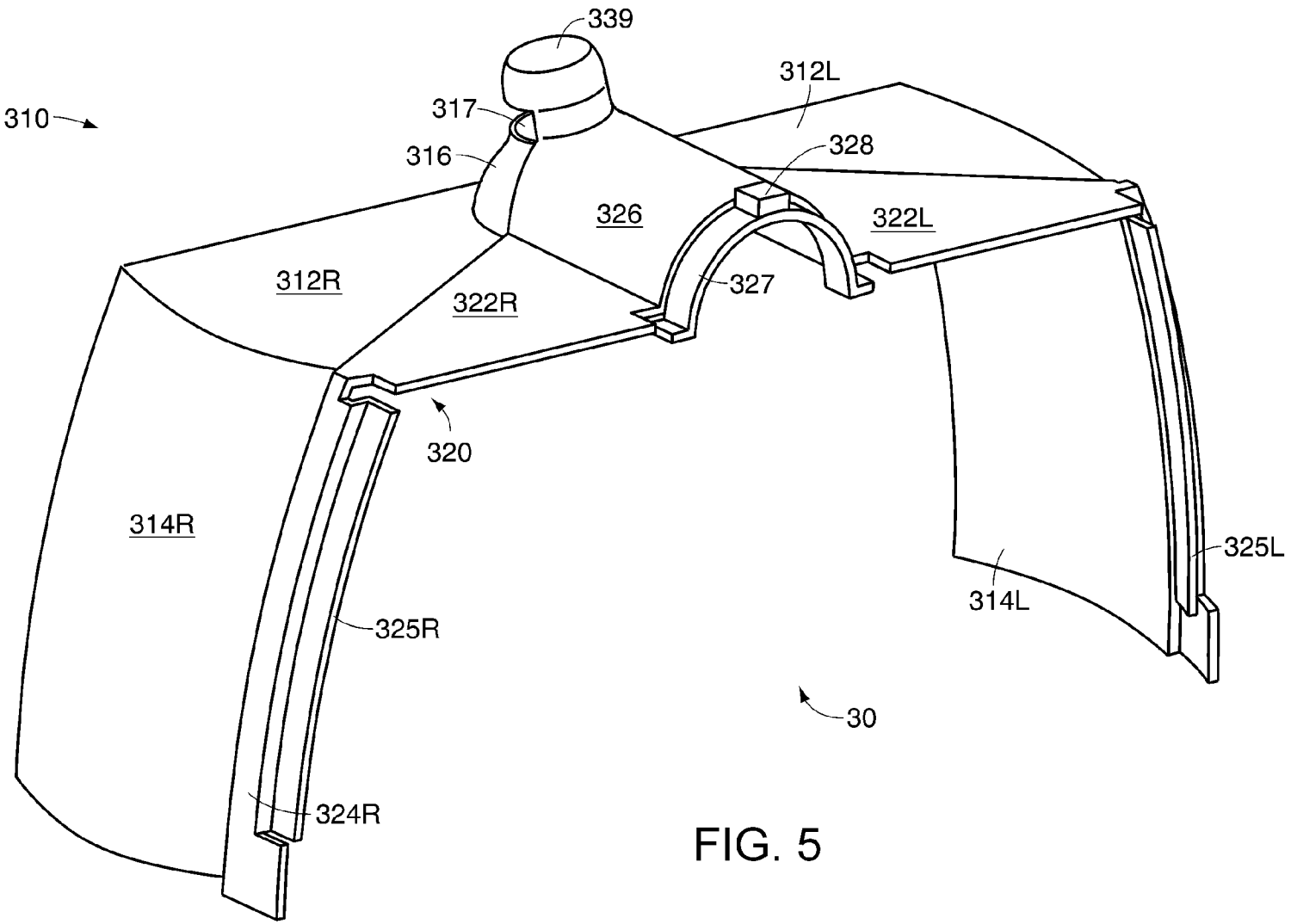
FIG. 5 is a perspective view of a coupler for the post end of a leaching chamber.

FIG. 5 is a perspective view of a coupler for the post end of a leaching chamber. The coupler 30 also includes a swivel body 310, which slidably rotates under the chamber 10 (FIG. 1). The coupler 30, however, interconnects with the post interconnect 138 (FIG. 2A) on the top of the chamber. To accomplish that task, an elevated circular dome coupler 339 is employed to mate with the chamber post interconnect.

The coupler body 310 includes left and right top section 312L, 312R and side sections 314L, 314R dimensioned to fit and slidably rotate within the mated chamber, like the coupler 20 of FIGS. 2 and 3. Likewise, the coupler 30 includes a subarch dome 316. For the coupler to rotate, a slit 317 separates the top of the subarch dome 136 from the dome coupler 319.

As also shown, the coupler 30 includes a flange section 320 that matches the flange of the mated, post end of the chamber 10. The flange 320 includes a lower subarch segment 327, left and right upper top segments 322L, 322R, left and right lower side segments 325L, 325R. At the top of the subarch 326 is a post interconnect 328.

It is recognized that the slit 317 may increase the migration of dirt and other debris into the chamber cavity after the chambers are buried. To reduce that effect, the leaching chambers (and similar couplers) can include a tongue feature at the lower subarch flange segment 137 (FIG. 2A) of the post end flange 130 (FIG. 2A). When connected to the coupler 30, the tongue can extend to or through the slit 317 to reduce or block the migration.

The above slit problem can be eliminated if the leaching chambers are manufactured with a receptacle for receiving the post member 218 (FIG. 2) under the chamber post connector 138 (FIG. 2A). In effect, there can be an indentation on the underside of the chamber and aligned with the center of the post connector. The relevant dimensions of the coupler could then be adjusted to mate with the post end of the chamber.

Figure 6:
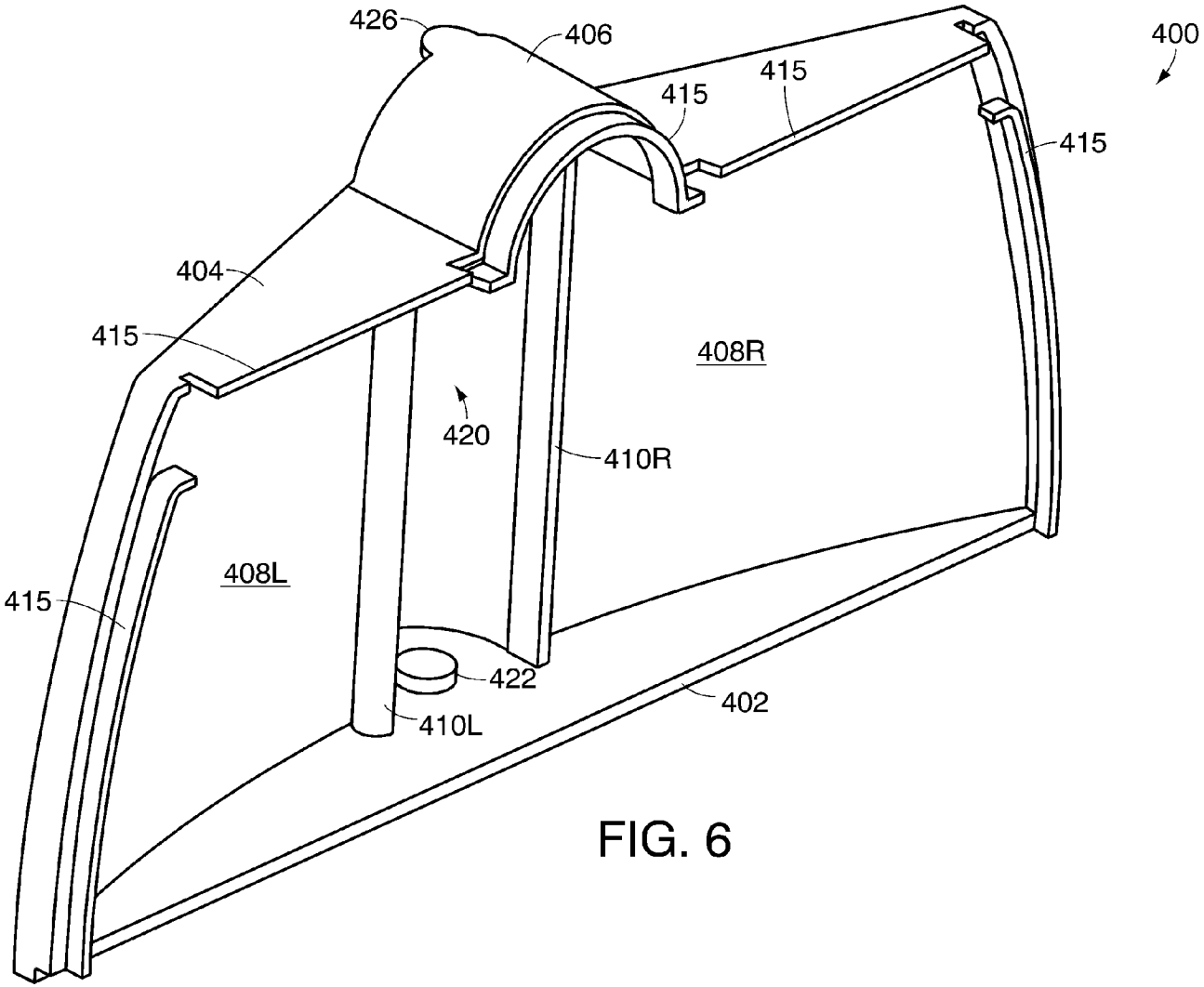
FIG. 6 is a perspective view of a first section of a swivel coupler assembly.
Figure 8:
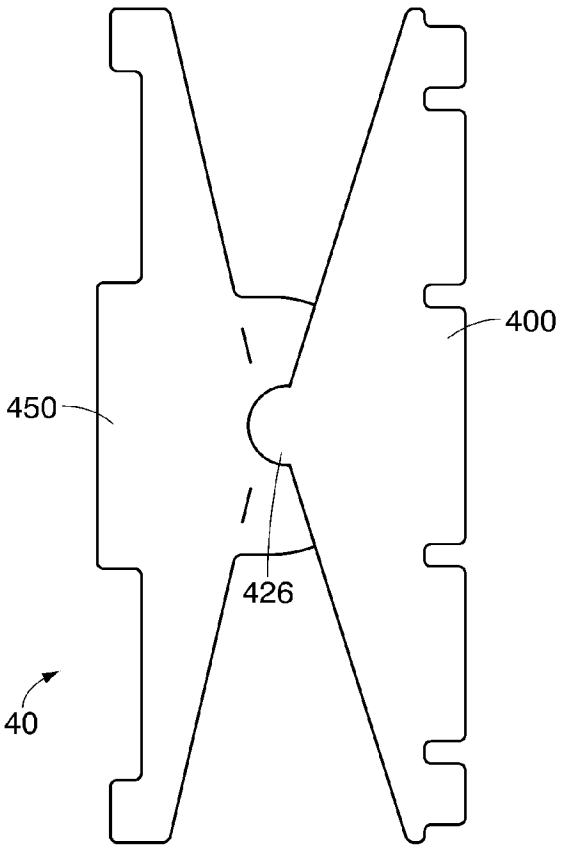
FIG. 8 is a schematic diagram of the assembled swivel coupler sections of FIGS. 6 and 7.
Figure 7:
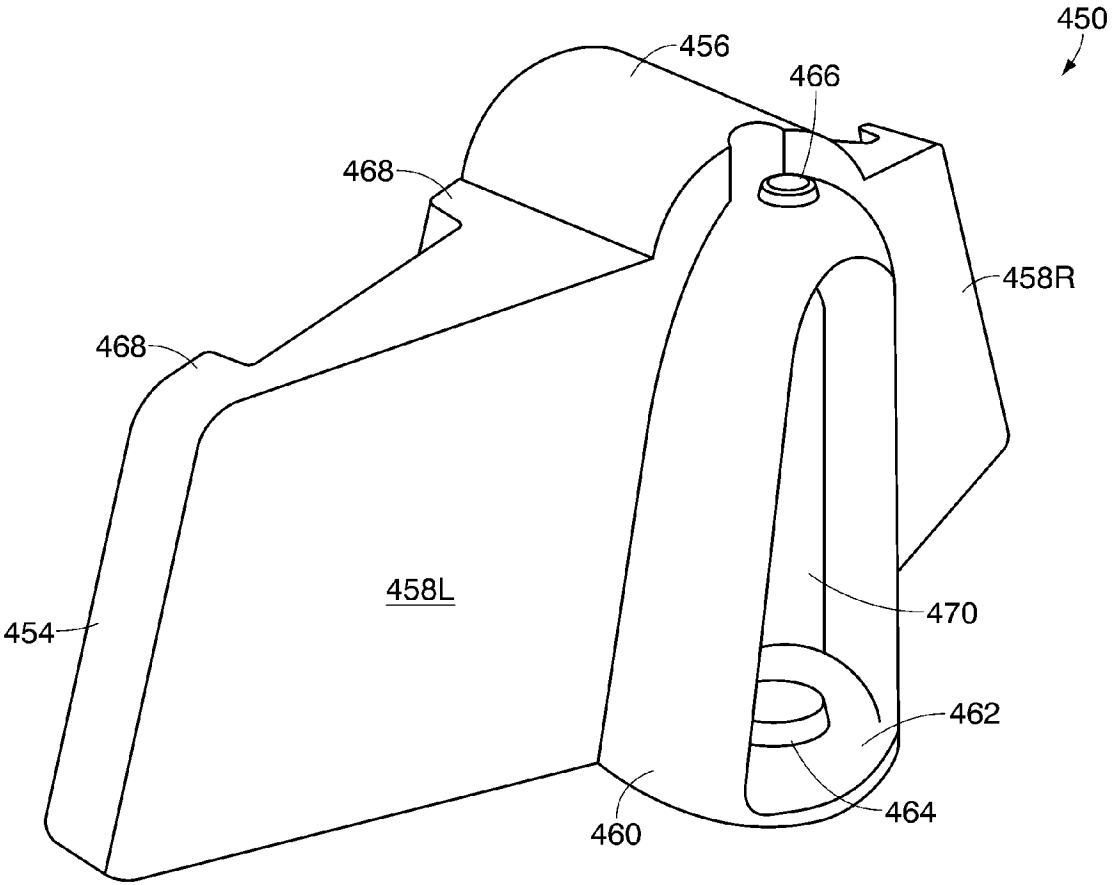
FIG. 7 is a perspective view of a second section a swivel coupler assembly.

The use of an adjustable coupler is not limited to chambers having post and dome interconnects. Embodiments can be employed for any type of leaching chamber. FIGS. 6-8 illustrate a coupler assembly having a swivel joint for mating between chambers.

FIG. 6 is a perspective view of a first section of a swivel coupler assembly. The first body 400 includes a floor 402, a top 404 having a subarch feature 406, and left and right walls 408L, 408R. The top 404 also forms flange segments 415 for mating with a specific chamber.

The walls 408L, 408R terminate at curved webs 410L, 410R. An opening 420 is thereby created between the webs 410L, 410R. A circular post connector 422 is formed in the floor 402 and a circular dome 426 is formed at the subarch 406.

FIG. 7 is a perspective view of a second section a swivel coupler assembly. The second body 450 includes a top 454 having a subarch feature 456 and left and right walls 458L, 458R. The top 454 also forms flange segment 468 for mating with a specific chamber.

The walls 458L, 458R terminate at a curved archway 460. The archway includes a floor 462 having a circular hole 464 that is dimensional to fit around the post 422 of the first body 40. A circular post 466 at the top of the archway 460 interconnects with the dome 426 of the first body 40. The archway 460 defines an opening 470.

FIG. 8 is a schematic diagram of the assembled swivel coupler sections of FIGS. 6 and 7. The curved webs 410L, 410R of the first body 400 cooperate with the shape of the archway 460 of the second body 450 to facilitate an angular adjustment between the coupler bodies 400, 450. Liquid can flow between chambers through the opening 470 of the archway 460.

It should be understood that the swivel coupler 40 can be employed with any leaching chamber system by altering the flange details. Examples of different flanges include shiplap-type flanges as shown and described in U.S. Pat. No. 4,759,661 entitled "Leaching System Conduit," which issued to Nichols et al. on Jul. 26, 1988; U.S. Design Pat. No. 329,684 entitled "Leaching Chamber," which issued to Gray on Sep. 22, 1992; U.S. Pat. No. 5,156,488 entitled "Leaching System Conduit with Sub-Arch," which issued to Nichols on Oct. 20, 1992; and U.S. Pat. No. 5,669,733 entitled "Angle Adapter for A Leaching Chamber System," which issued to Daly et al. on Sep. 23, 1997. The flanges can also be other alternating segmented flanges as shown and described in U.S. Pat. No. 6,076,993 entitled "Leaching Chamber," which issued to Gray on Jun. 20, 2000. It should be recognized that the chambers may lack end flanges and interconnect differently, such as shown and described in U.S. Pat. No. 980,442 entitled "Draining Culvert," which issued to Schlafly on Jan. 3, 1911; U.S. Pat. No. 2,153,789 entitled "Irrigation and Drainage Tube," which issued to Carswell et al on Apr. 11, 1939; and U.S. Pat. No. 4,360,042 entitled "Arched Conduit with Improved Corrugations," which issued to Fouss et al. The teachings of the above-referenced patents are all incorporated herein by reference in their entirety.

It should also be understood that a coupler for chambers having a post and dome interconnect could swivel about both the post interconnect and the dome interconnect of adjacent chambers. Such a coupler could replace the flange end of the coupler of FIG. 3 with the rotatable coupling, such as shown in FIG. 5.

Figure 9:
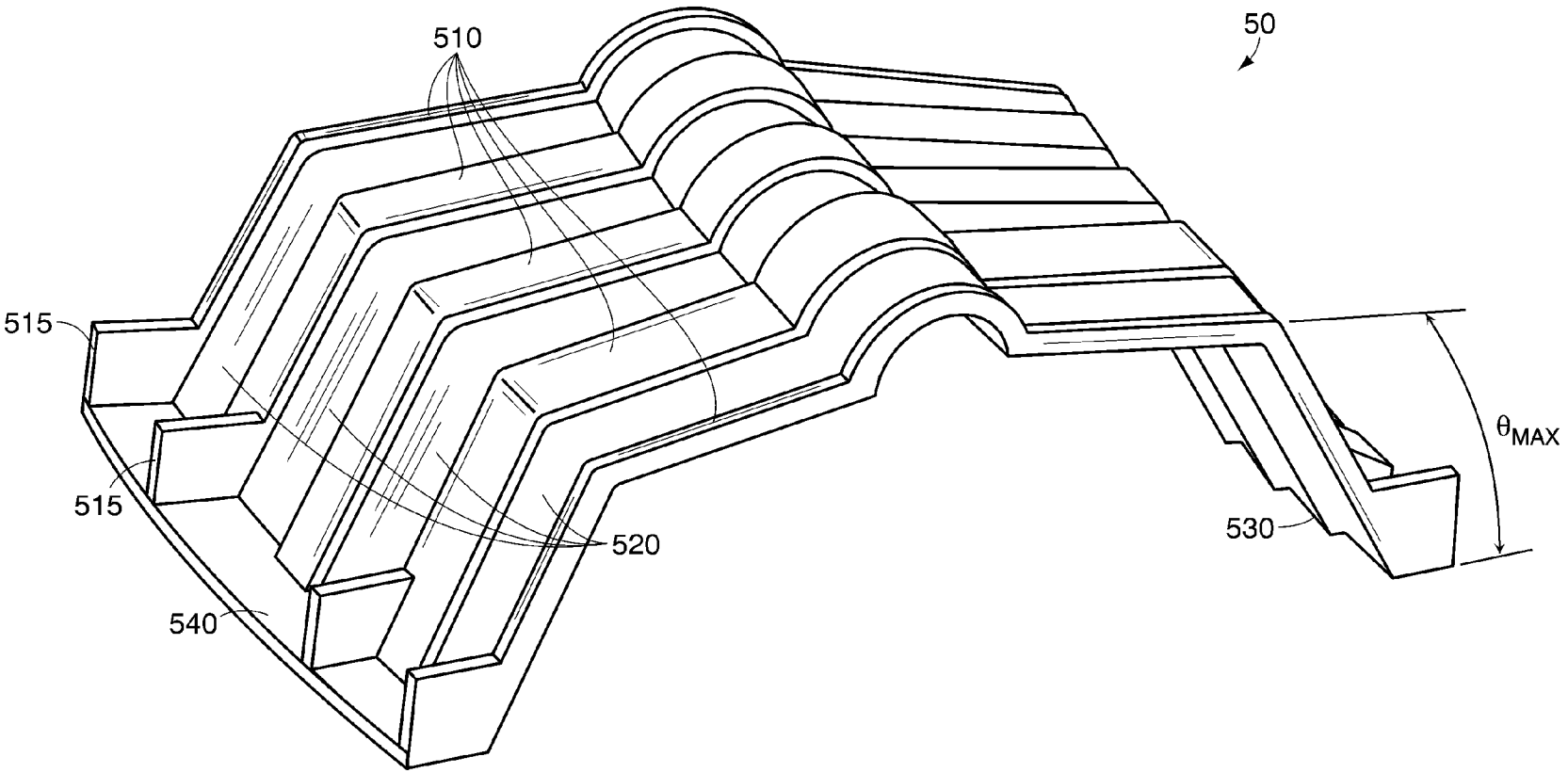
FIG. 9 is a perspective view of an adjustable coupler insert.

FIG. 9 is a perspective view of an adjustable coupler insert. The coupler insert 50 includes peak corrugations 510 and valley corrugations 520. The footprint of the coupler insert is in the shape of a segment of a toroid. That is, an inner base flange 530 is curved to have a first radius and an outer flange 540 is curved to have a second radius greater than the first radius. The result is a maximum relative turning angle $\theta_{MAX}$, from end to end, of 45°. Also shown are support gussets 515 connecting the peak corrugations to the outer flange 540.

Figure 10A:
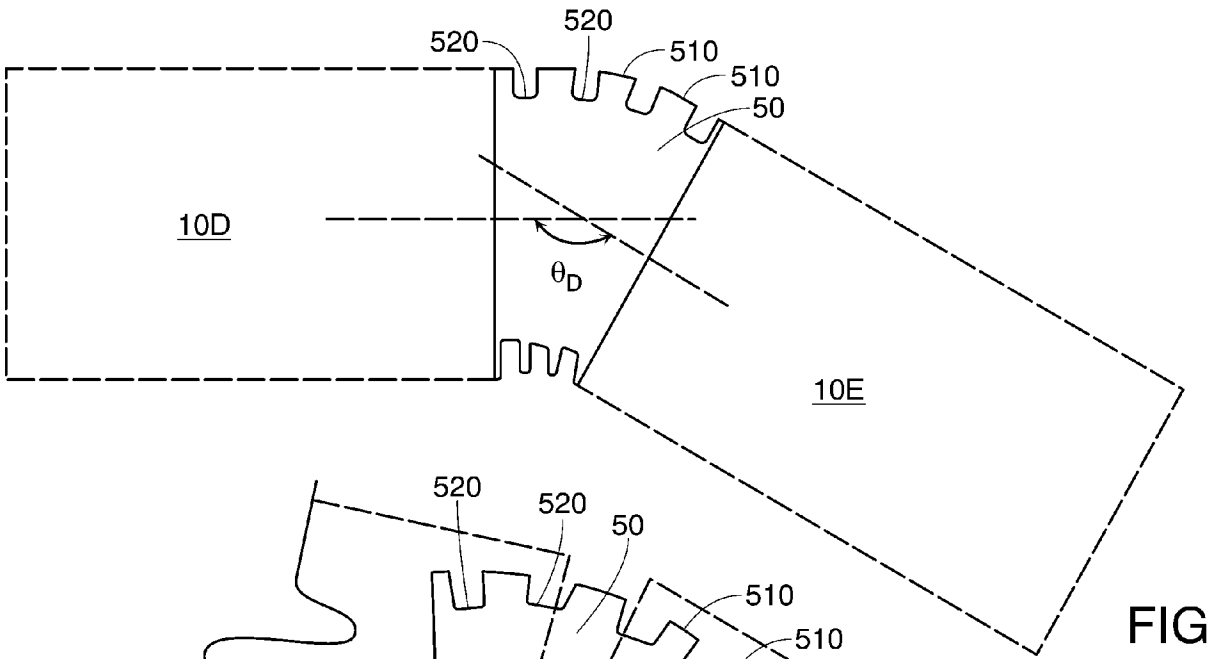
FIG. 10A-10B are schematic diagrams illustrated the use of the adjustable coupler insert of FIG. 9.
Figure 10B:
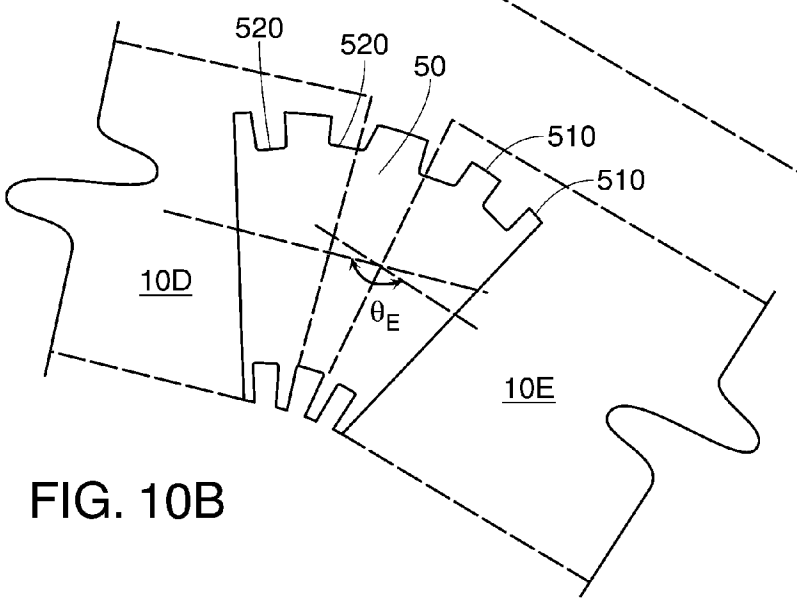

FIG. 10A-10B are schematic diagrams illustrated the use of the adjustable coupler insert of FIG. 9. As shown, the coupler insert 50 joins two chambers 10D, 10E. The turning angle between the chambers can be adjusted by sliding one or both chambers 10D, 10E over the coupler insert 50 until the desired angle $\theta_D$, $\theta_E$ is achieved.

The leaching chambers and couplers described herein can be prefabricated as a substantially rigid body from high density polyethylene (HDPE). In particular, the leaching chambers are fabricated from T60-800 HDPE. The wall thickness can be between 0.200 and 0.250 inches. Alternatively, the leaching chambers can be made of other suitable polymers or from other substantially rigid materials such as concrete, ceramics or metals.

While this coupler for leaching chamber systems has been particularly shown and described with references to particular embodiments, it will be understood by those skilled in the art that various changes in form and details may be made without departing from the spirit and scope of the invention as defined by the appended claims. For example, different ranges of angles can be used depending on the application.

What is claimed is:

1. A coupler for connecting two arch-shaped cross section leaching chambers to form a pathway for transporting and dispersing liquid, the coupler comprising:

a first end that is matable with a first leaching chamber having a longitudinal axis along a first direction;

a second end that is matable with a second leaching chamber having a longitudinal axis along a second direction;

a curved body between the first end and the second end such that the longitudinal axis of the first leaching chamber and the longitudinal axis of the second leaching chamber form an acute angle when mated; and an adjustment feature to adjust the acute angle within a range of angles.

2. The coupler of claim 1 wherein the adjustment feature includes a swivel connection.

3. The coupler of claim 1 wherein the first end and the second end of the coupler are matable with the first leaching chamber and the second leaching chamber, respectively.

4. The coupler of claim 3 wherein the first end of the coupler is overlappable by the first leaching chamber and the second leaching chamber is overlappable by the second end of the coupler.

5. The coupler of claim 4 wherein the first end of the coupler includes a post connector structure and the second end of the coupler includes a dome connector structure.

6. The coupler of claim 5 wherein the dome connector structure includes a slit for receiving a portion of the second leaching chamber.

7. The coupler of claim 1 wherein the coupler is arch shaped in cross section.

8. The coupler of claim 1 wherein the adjustment feature includes a post connector member.

9. The coupler of claim 1 wherein the adjustment feature includes a dome connector structure.

10. The coupler of claim 1 wherein the adjustment feature is bidirectional.

11. A leaching field for dispersing a liquid along a serpentine pathway, comprising:

a first arch-shaped cross section leaching chamber having a longitudinal axis along a first direction;

a second arch-shaped cross section leaching chamber having a longitudinal axis along a second direction;

a coupler connecting the first and second leaching chambers to form a pathway for transporting and dispersing liquid, the coupler comprising:

a first end mated with the first leaching;

a second end mated with a second leaching chamber;

a curved body between the first end and the second end such that the longitudinal axis of the first leaching chamber and the longitudinal axis of the second leaching chamber form an acute angle; and an adjustment feature to adjust the acute angle within a range of angles.

12. The leaching field of claim 11 wherein the adjustment feature is a swivel connection.

13. The leaching field of claim 11 wherein the first end and the second end of the coupler are matable with the first leaching chamber and the second leaching chamber, respectively.

14. The leaching field of claim 13 wherein the first end of the coupler is overlappable by the first leaching chamber and the second leaching chamber is overlappable by the second end of the coupler.

15. The leaching field of claim 14 wherein the first end of the coupler includes a post connector structure and the second end of the coupler includes a dome connector structure.

16. The coupler of claim 15 wherein the dome connector structure includes a slit for receiving a portion of the second leaching chamber.

17. The leaching field of claim 11 wherein the coupler is arch shaped in cross section.

18. The leaching field of claim 11 wherein the adjustment feature includes a post connector member.

19. The leaching field of claim 11 wherein the adjustment feature includes a dome connector structure.

20. The leaching field of claim 11 wherein the adjustment feature is bidirectional.

21. A method of manufacturing a coupler for connecting two arch-shaped cross section leaching chambers to form a pathway for transporting and dispersing liquid, the method comprising:

fabricating a first end that is matable with a first leaching chamber having a longitudinal axis along a first direction;

fabricating a second end that is matable with a second leaching chamber having a longitudinal axis along a second direction;

fabricating a curved body between the first end and the second end such that the longitudinal axis of the first leaching chamber and the longitudinal axis of the second leaching chamber form an acute angle when mated; and fabricating an adjustment feature to adjust the acute angle within a range of angles.

22. The method of claim 21 wherein fabricating the adjustment feature comprises fabricating a swivel connection.

23. The method of claim 21 wherein the first end and the second end of the coupler are fabricated to mate with the first leaching chamber and the second leaching chamber, respectively.

24. The method of claim 23 wherein the first end of the coupler is fabricated to be overlapped by the first leaching chamber and the second end of the coupler is fabricated to overlap the second leaching chamber.

25. The method of claim 24 wherein fabricating the adjustment feature comprises fabricating the first end of the coupler to include a post connector structure and the second end of the coupler to include a dome connector structure.

26. The method of claim 25 further comprising fabricating a slit in the dome connector structure for receiving a portion of the second leaching chamber.

27. The method of claim 21 wherein the coupler is arch shaped in cross section.

28. The method of claim 21 wherein fabricating the adjustment feature includes fabricating a post connector member.

29. The method of claim 21 wherein fabricating the adjustment feature includes fabricating a dome connector structure.

30. The method of claim 21 wherein the adjustment feature is bidirectional.

31. A method of making a leaching field for dispersing a liquid along a serpentine pathway, comprising:

providing a first arch-shaped cross section leaching chamber having a longitudinal axis along a first direction;

providing a second arch-shaped cross section leaching chamber having a longitudinal axis along a second direction;

connecting the first and second leaching chambers with a coupler to form a pathway for transporting and dispersing liquid, the coupler comprising:

a first end that mates with the first leaching;

a second end that mates with a second leaching chamber;

a curved body between the first end and the second end such that the longitudinal axis of the first leaching chamber and the longitudinal axis of the second leaching chamber form an acute angle; and an adjustment feature to adjust the acute angle within a range of angles.

32. The method of claim 31 wherein the adjustment feature is a swivel connection.

33. The method of claim 31 wherein connecting comprises mating the first end and the second end of the coupler with the first leaching chamber and the second leaching chamber, respectively.

34. The method of claim 31 wherein the first end of the coupler is fabricated to be overlapped by the first leaching chamber and the second end of the coupler is fabricated to overlap the second leaching chamber.

35. The method of claim 34 wherein the first end of the coupler includes a post connector structure and the second end of the coupler includes a dome connector structure.

36. The method of claim 35 wherein the dome connector structure includes a slit and connecting comprises receiving a portion of the second leaching chamber in the slit.

37. The method of claim 31 wherein the coupler is arch shaped in cross section.

38. The method of claim 31 wherein fabricating the adjustment feature includes fabricating a post connector member.

39. The method of claim 31 wherein fabricating the adjustment feature includes fabricating a dome connector structure.

40. The method of claim 31 wherein the adjustment feature is bidirectional.

41. A coupler for connecting two arch-shaped cross section leaching chambers to form a pathway for transporting and dispersing liquid, the coupler comprising:

a first end that is matable with a first leaching chamber having a longitudinal axis along a first direction;

a second end that is matable with a second leaching chamber having a longitudinal axis along a second direction;

a curved body between the first end and the second end such that the longitudinal axis of the first leaching chamber and the longitudinal axis of the second leaching chamber form an acute angle when mated; and an adjustment feature including a swivel connection to adjust the acute angle within a range of angles.

42. The coupler of claim 41 wherein the first end and the second end of the coupler are matable with the first leaching chamber and the second leaching chamber, respectively.

43. The coupler of claim 42 wherein the first end of the coupler is overlappable by the first leaching chamber and the second leaching chamber is overlappable by the second end of the coupler.

44. The coupler of claim 43 wherein the first end of the coupler includes a post connector structure and the second end of the coupler includes a dome connector structure.

45. The coupler of claim 44 wherein the dome connector structure includes a slit for receiving a portion of the second leaching chamber.

46. The coupler of claim 41 wherein the coupler is arch shaped in cross section.

47. The coupler of claim 41 wherein the adjustment feature includes a post connector member.

48. The coupler of claim 41 wherein the adjustment feature includes a dome connector structure.

49. The coupler of claim 41 wherein the adjustment feature is bidirectional.

50. A method of manufacturing a coupler for connecting two arch-shaped cross section leaching chambers to form a pathway for transporting and dispersing liquid, the method comprising:

fabricating a first end that is matable with a first leaching chamber having a longitudinal axis along a first direction;

fabricating a second end that is matable with a second leaching chamber having a longitudinal axis along a second direction;

fabricating a curved body between the first end and the second end such that the longitudinal axis of the first leaching chamber and the longitudinal axis of the second leaching chamber form an acute angle when mated; and fabricating an adjustment feature having a swivel connection to adjust the acute angle within a range of angles.

51. The method of claim 50 wherein the first end and the second end of the coupler are fabricated to mate with the first leaching chamber and the second leaching chamber, respectively.

52. The method of claim 51 wherein the first end of the coupler is fabricated to be overlapped by the first leaching chamber and the second end of the coupler is fabricated to overlap the second leaching chamber.

53. The method of claim 52 wherein fabricating the adjustment feature comprises fabricating the first end of the coupler to include a post connector structure and the second end of the coupler to include a dome connector structure.

54. The method of claim 53 further comprising fabricating a slit in the dome connector structure for receiving a portion of the second leaching chamber.

55. The method of claim 50 wherein the coupler is arch shaped in cross section.

56. The method of claim 50 wherein fabricating the adjustment feature includes fabricating a post connector member.

57. The method of claim 50 wherein fabricating the adjustment feature includes fabricating a dome connector structure.

58. The method of claim 50 wherein the adjustment feature is bidirectional.

* * * * *